United States Patent [19]

Morin

[11] 4,224,869

[45] Sep. 30, 1980

[54] PARALLEL LINE PRINTER

[75] Inventor: Claude Morin, Meudon, France

[73] Assignee: Enertec, Montrouge, France

[21] Appl. No.: 919,685

[22] Filed: Jun. 27, 1978

[30] Foreign Application Priority Data

Jun. 28, 1977 [GB] United Kingdom ..... 26958/77

[51] Int. Cl.[3] ..... B41J 7/70

[52] U.S. Cl. ..... 101/93.04; 101/1; 400/551; 400/120

[58] Field of Search ..... 101/1, 93.04, 93.05; 400/551, 120

[56] References Cited

U.S. PATENT DOCUMENTS

| | | | |
|---|---|---|---|
| 2,895,585 | 7/1959 | Guldner et al. | 400/551 |
| 3,633,720 | 1/1972 | Tyler | 101/1 X |
| 3,919,935 | 11/1975 | Langnickel | 101/93.04 |
| 3,967,714 | 7/1976 | Potma et al. | 101/93.05 X |
| 3,991,671 | 11/1976 | Aizawa et al. | 101/93.04 |
| 4,024,506 | 5/1977 | Spaargaren | 101/93.04 X |

*Primary Examiner*—Edward M. Coven

[57] ABSTRACT

According to a representative embodiment of the invention, a parallel line printer such as a thermal printer is provided having a parallel printing head with a plurality of printing elements arranged to extend across the width of a paper strip. Electrical signals representative of characters to be printed can be stored in a storage device having a capacity corresponding to a full line of characters, and a print control logic is operative to cause the printing head to print up to a full line of characters simultaneously, or substantially so, in response to a print command. Means are provided to permit printing to be resumed on a line already containing characters printed in response to certain print commands. In the case when the paper is typically moved forward after one line has received print, means are provided to return such line back under the printing head if printing must resume on such line. A print command initiating a printing operation before the characters of a full line have been received may be produced whenever the time interval between successive ones of the character representative signals received exceeds a predetermined length.

32 Claims, 5 Drawing Figures

PARALLEL LINE PRINTER

BACKGROUND OF THE INVENTION

This invention relates to printing apparatus for printing successive lines of characters across the width of a strip of paper and is more particularly concerned with such printing apparatus of the so-called parallel type, as examplified in thermal printers, which is capable of printing all the characters of a line simultaneously or substantially so.

Known thermal printers of this type typically print lines of characters containing up to 20 characters in some models and 80 characters in others, each character being made up of dots from a 5×7 dot matrix. Because such printers print very rapidly, they are frequently used in conjunction with data processors, and to this end they normally include a store into which electrical signals representative of a complete line of characters can be entered by the data processor. When the store contains a complete line of 80 characters, or when the data processor produces an "end of line" or "line feed" signal, the printer simultaenously prints all the characters of that line. However, it is usually also possible to enter such character representative signals into the store manually, e.g., by means of a keyboard, in which case the keyboard may also be arranged to produce the aforementioned "end of line" signal. This arrangement has the disadvantage that the keyboard operator must enter electrical signals (i.e., operate keys) corresponding to a complete line of characters, possibly containing as many as 80 characters, before printing can take place and the operator can visually check the accuracy of his entries. The effects of this disadvantage are increased if the keyboard operator is relatively slow and/or unskilled, particularly if the operator makes an error requiring corrective action early in a line.

More generally, it would be desirable to provide a printer capable of operating in the parallel mode which is more flexible in use than known parallel printers. According to one aspect of the invention a parallel line printing apparatus is provided for printing successive lines of characters across the width of a strip of print support material comprising:

parallel printing head means having a plurality of aligned printing elements arranged to extend across the width of the print support material strip;

electrical signal storage means for receiving and storing electrical signals representative of characters to be printed, said storage means having a capacity sufficient to store electrical signals corresponding to a plurality of characters print control means responsive to at least one print command signal for performing a printing operation by causing said printing head means to substantially simultaneously print characters corresponding to electrical signals stored in said storage means along less than a full line on the print support material opposite said printing head means;

said print control means being responsive to a print command signal for causing said printing head means to resume after said printing operation the printing of characters along a line containing at least one character already printed during said printing operation. According to another aspect of the invention a parallel line printing apparatus is provided for printing successive lines of characters across the width of a strip of print support material, comprising:

parallel printing head means having a plurality of aligned printing elements arranged to extend across the width of the print support material strip;

electrical signal storage means for receiving and storing electrical signals representative of characters to be printed, said storage means having a capacity sufficient to store electrical signals corresponding to a plurality of characters;

print control means responsive to at least one print command signal for performing a printing operation by causing said printing head means to print up to a full line of characters corresponding to electrical signals stored in said storage means along a line of print support material opposite said printing head means;

moving means for producing relative displacement between the printing head means and the print support material transversely of the direction of print of a line by said printing head means on the print support material;

means for controlling said moving means to produce such relative displacement in a forward direction after each such print command signal has been received so that the printing head means is displaced with respect to the line containing any character just printed in response to such print command signal;

said controlling means being selectively responsive to at least one such print command signal to produce such a relative displacement in a reverse direction to a position wherein a line containing at least one character already printed is back opposite said printing head means. According to still a further aspect of the invention, a parallel line printing apparatus is provided for printing successive lines of characters across the width of a strip of print support material, comprising:

parallel printing head means having a plurality of aligned printing elements arranged to extend across the width of the print support material strip;

electrical signal storage means for receiving and storing electrical signals representative of characters to be printed, said storage means having a capacity sufficient to store electrical signals corresponding to a plurality of characters;

timing means for producing a print command signal when the duration of a time interval between successive ones of said electrical signals exceeds a predetermined value; and print control means responsive to said print command signal for causing said printing head means to print one or more characters corresponding to electrical signals stored in said storage means when said print command signal is produced.

Further features and advantages of the invention will become more readily apparent form the following detailed description when taken in conjunction with the accompanying drawings.

Figure 1:
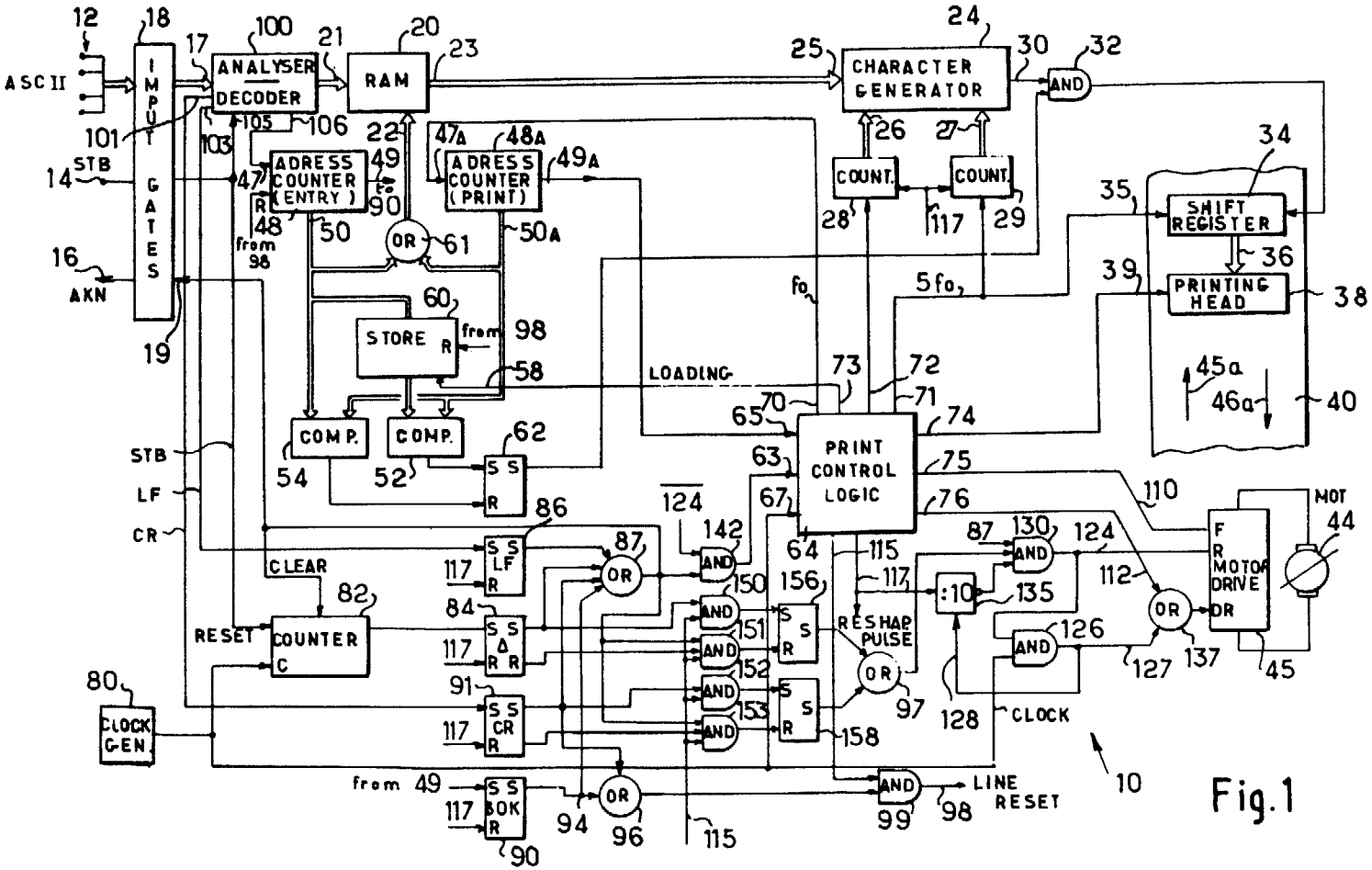
FIG. 1 is a schematic diagram of a parallel printer in accordance with the present invention.

The parallel printer shown in FIG. 1 is a thermal line printer indicated generally at 10, of the type which simultaneously prints a plurality of alphanumeric characters in a line which can contain up to 80 such characters. Each printed character is made up of dots selected from a 5×7 matrix of possible dot positions, as will become apparent hereinafter.

Such printers are well known in the art, as examplified by printer model 9866A manufactured and sold by the Hewlett Packard Company of California. Other printers operating on the same principle print up to 20 characters per line are also available and well known such as Hewlett Packard Model HP 5150A.

The operating principles and technologies of these printers are well known and will only be discussed here to the extent necessary to understand the invention; conventional circuits to produce signals used for operating conventional printers, or equivalent signals, will thus not be described in detail for the sake of simplicity and clarity.

The printer 10 has a plurality of inputs 12 connected to receive a series of bit-parallel digital electrical signals representative of the characters to be printed; typically, these character-representative signals are in 7-bit ASCII code. The printer 10 has one further input 14 which is connected to receive a strobe pulse STB each time a character-representative signal is received at the inputs 12 and one output AKN connected to indicate to the source of signals to be printed whether the printer is or not available for receiving additional character-representative signals at the inputs 12. It should be noted that the signals at the inputs 12 will normally include some which are representative of spaces between characters, e.g., between a character constituting the end of one word and a character constituting the beginning of the next word: these space-representative signals are equivalent to character-representative signals are so treated in the printer 10. They are considered as printable characters as opposed to other signals which are received on the inputs 12 and do not correspond to printable characters. Among the latter, some may correspond to print commands such as a "line feed" LF signal indicating that the printer must go to the next line even though a full 80 characters have not been yet received, or a "carriage return" CR signal indicating that the printer must return to the beginning of the line already printed in whole or in part.

The character-representative and strobe signals are produced in known manner by manually operable keyboard (not shown) and/or by a data processor (not shown) which is/are responsive to the AKN signal 16.

The inputs 12 are connected, via gates 18 having an input 19 controlling the production of the AKN availability signal, to corresponding inputs 17 of an analyzer-decoder 100 which distinguishes the printable character representative signals from the others and further decodes the print commands such as LF or CR which may be present in the non-printable signals and appear on outputs 103 and 101 thereof, respectively.

The signals representative of printable characters appear at a plurality of outputs of the analyzer-decoder 100 which are connected to corresponding inputs 21 of a random access memory (or RAM) 20 having 80 addressable storage locations in which it can store 80 of the aforementioned printable 7-bit character-representative signals. The RAM 20 has a plurality of address inputs 22, and its outputs 23 are coupled to corresponding inputs 25 of a character generator 24. The character generator 24 has further groups of inputs 26 and 27 which are respectively connected to the count outputs of two counters 28 and 29, and is typically of a known type comprising a read only memory (or ROM) arranged to convert 7-bit ASCII signals into 5×7 dot matrix character signals. The character generator 24 has an output 30 connected via an AND gate 32 to the input of a 400-stage shift register store 34.

The store 34 has a shift input 35, and 400 parallel outputs 36 which are connected to individual resistive dot-printing elements (not shown) of a 400-element thermal printing head 38 of known construction. The printing head has a print enabling input 39, and is supported so as to be in contact with a strip 40 of thermally-sensitive paper. The printing elements of the printing head 38 are arranged in groups of five and aligned with each other in a direction extending across the width of the strip 40, and each of them, when energized by a current pulse of suitable duration and magnitude (e.g., 40 milliamps for 15 milliseconds or 80 milliamps for 1.5 millisecond) is resistively heated by the current pulse so as to produce a single dot on the paper. The strip of paper 40 is longitudinally movable with respect to the printing head 38 under the control of a reversible stepping motor 44, which drives the paper by means of a drum (now shown) around which the paper is partly wrapped so as to be driven by its frictional engagement with the drum. Alternatively, the motor 44 may drive the paper by means of sprocket wheels which engage spaced holes along each edge of the paper. The motor 44 is connected to the outputs of a motor drive control circuit 45 which has respective forward and reverse control inputs F and R and a drive input DR, the application of suitable pulses to input DR driving the motor such that the strip of paper 40 moves in the forward or reverse directions in accordance with which input F or R is energized.

The input 14 is connected via the gating circuit 18 to a strobe input 105 of the decoder-analyzer 100 which has an output 106 connected to a count input 47 of an address counter 48, which is used to enter character representative signals in the RAM 20, and has an overflow output 49 at which it produces an overflow pulse when it reaches its maximum count of 80. The analyzer-decoder 100 produces a pulse on its output 106 in response to the strobe pulse STB on its input 105 each time the corresponding character representative signal received on its inputs 17 is determined to correspond to a printable character. The counter 48 also has a set of parallel count outputs 50 which are connected via first inputs of an OR circuit 61 to the address inputs 22 of the RAM 20 and to first inputs of a digital comparator 54. The count outputs 50 of the counter 48 are also connected to a set of parallel inputs of a register or store 60, which has a respective enabling input 58 and parallel outputs connected to first inputs of a digital comparator 52. A second address converter $48_A$ is provided, having a count input $47_A$, an overflow output $49_A$, and address outputs $50_A$ connected via second inputs of OR circuit 61 to the address inputs 22 of RAM 20. Address outputs $50_A$ are also connected to respective second inputs of comparators 52 and 54. Address counter $48_A$ is operative during the printing process as will be explained later on.

The respective outputs of comparators 52 and 54 are connected to the set and reset inputs of a bistable circuit 62. The set output of the bistable circuit 62 is connected to an enabling input of the AND gate 32.

The LF output 103 of analyzer-decoder 100 is connected to the set input of a bistable circuit 86, whose set output is connected to one input of a four-input OR gate 87. The output of the OR gate 87 is connected to the input 19 of the gating circuit 18. The overflow output 49 of address counter 48 is connected to the set input of a bistable circuit 90. The set output of this bistable 90 is coupled one respective input of the four-input OR gate 87.

The CR output 101 of analyzer-decoder 100 is connected to the set inputs of a bistable circuit 91 whose set output is coupled to a respective input of four-input OR gate 87.

The input 14 (STB) of the printer 10 is also connected, again via the gating circuit 18, to the reset input of a counter 82, whose count input C is connected to the output of a clock pulse generator 80 and which has a CLEAR input coupled to the output of OR 87. The maximum count of the counter 87 is selected so that it produces an overflow pulse at its overflow output after counting the pulses from the generator 80 for a period of time which may, for example, be adjusted to about half a second. The overflow output of the counter 82 is connected to the set input of a bistable circuit 84. The set output of bistable 84 is connected to the last of the four inputs of the OR gate 87.

The output of the OR gate 87 is also connected via a normally enabled AND gate 142 to a first input 63 of a print control logic circuit 64 which has further inputs 65 and 67 and outputs puts 70 to 76, 115 and 117. The input 65 is connected to the overflow output $49_A$ of the counter $48_A$, and the input 67 is connected to the output of the clock pulse generator 80, which has a typical operating frequency of 500 kHz, and determines the timing of the various functions performed by the circuit 64. The output 70 is connected to the count input $47_A$ of the counter $48_A$, the output 71 is connected to the count input of the counter 29 and to the shift input 35 of the register 34, the output 72 is connected to the count input of the counter 28, the output 73 is connected to the enabling input 58 of the store 60, the output 74 is connected to the print input 39 of the printing head 38, the output 75 is connected via line 110 to the F input of motor drive circuit 45 and the output 76 is connected to an input 112 of a two-input OR gate 137 whose output is respectively coupled to input DR of the motor drive circuit 45.

Output 115 of the circuit 64 is coupled to one input of a two-inputs AND gate 99 whose other input is connected to the output of an OR gate 96 having one input connected to the set output 94 of bistable 90 and an other input connected to the set output of CR bistable 91. The output of AND gate 99 is a line reset output 98 connected by lines (not shown) to the reset inputs of store 60 and address counter 48.

Output 117 of circuit 64 is connected by lines not shown to the reset inputs of the counters 27 and 28, bistable circuits 84, 86, 90 and 91 and to the reset input of a divide-by-ten circuit 135. Output 140 of divide-by-ten circuit 135 is connected to one input of a three-input AND gate 130 which has its other two inputs respectively connected to output of OR gate 87 and to the output of a two-input OR gate 97. The output 124 of AND gate 130 is connected to the R input of drive circuit 45 and to one input of a two-input AND gate 126 having its other input coupled to the output of clock 80 and its output connected to the other input 127 of OR gate 137 and to a pulse count input 128 of the divide-by-ten circuit 135.

Finally, the two inputs of OR gate 97 are connected to respective set outputs of two bistables 156 and 158, whose set inputs are respectively coupled to the outputs of two respective two-input AND gates 150 and 152 and whose reset inputs are coupled to the outputs of two respective three-input AND gates 151 and 153. Gates 150–153 each have one input coupled to output 115 of control logic circuit 64. Gates 150 and 152 each have one input connected to the set output of bistables 84 ($\rho$) and 91 (CR) and gates 151 and 153 each have one input connected to the reset output of these bistables 84 and 91 respectively. Finally, third inputs of gates 151 and 153 are connected to the output of gate OR 87.

The operation of the printer 10 will now be discussed by considering first how the character representative signals are entered and then, how they are printed.

I. CHARACTER ENTERING PROCESS

It is assumed that upon turning on the power to the apparatus all circuits are reset, counters 28, 29, 48, $48_A$ and 82 being initially set to zero, RAM 20 being initially clear. The AKN signal on output 16 indicates that the printer is available for receiving ASCII signals on inputs 12 and a corresponding strobe STB on input 14 for each ASCII coded character received on inputs 12.

Each strobe pulse STB resets counter 82 and enables analyzer-decoder 100 to operate as follows:

(1) If the character representative signal on its inputs 17 is printable, decoder 100 produces a corresponding character validation pulse on count input 47 of address counter 48.

(2) If the character representative signal on its input 17 is not printable, analyzer-decoder 100 further analyzes it to distinguish if such signal corresponds to an external print command which may be:

(a) A CR signal to produce a pulse on output 101 indicating that the line of characters received so far must be printed and the address counter 48 reset without changing line for the next printing operation.

(b) A LF signal to produce a pulse on output 103 indicating that the line received so far must be printed without modifying the content of the address counter 48 and the printer must go to the next line before the next printing starts.

Thus, a command for a conventional line change to a new paragraph must comprise a sequence of a code LF and a code CR, or vice versa. The count in address counter 48 determines the address where the respective printable character representative signal transferred by the decoder 100 to input 21 of the RAM is going to be stored in the RAM 20. Such printable character entering process is carried on with each strobe signal STB until it stops when a print command is produced at the output of OR gate 87 which operates to cancel the acknowledge signal AKN on output 16 via input 19, to clear the counter 82, and to render the printer unavailable for the entry of new characters.

Such print control signal may be the result of four separate events:

(1) setting of bistable 86 by an LF command from 103;

(2) setting of bistable 91 and a CR command from 101;

(3) setting of bistable 90 by an overflow pulse on output 49 of address counter 48 after a full line of 80 printable characters has been received, and (4) setting of bistable 84 by an overflow pulse from counter 82 in the event that the time interval between two consecutive strobe pulses STB is greater than a predetermined time interval, e.g., half a second, which may occur particularly in the case of manual entry characters to the printers by means of a keyboard.

Any one of those four events will produce an indication at the output of OR gate 87 that a printing operation must be performed.

II. CHARACTER PRINTING PROCESS

Each printable character is to be printed by printing an appropriate combination of dots distributed between seven character sublines, a character having up to 5 dots in each subline. In other words for each character of a line, five printing elements are involved which may be selectively heated when the paper is advanced in seven successive relative positions with respect to the head, each position corresponding to a subline.

The address counter 48 contained the address of the last character entered at the time a printing operation must be initiated. As will become apparent hereinafter the store 60 always contains the address of the last character printed, i.e., zero if no printing has occurred yet for the line of characters under consideration. This is done by producing a loading pulse on enabling input 58 of store 60 at the end of the printing operation which result in the transfer of the content of address counter 48 into store 60.

Assuming for the moment that AND gate 142 is passing, the print command issued from OR gate 87 is applied to input 63 of the print control logic 64 and triggers (see timing diagram of FIG. 2) the printing operation by producing a first subline pulse on its output 72, and supplying a pulsed signal at a frequency $f_o$ on its output 70, and a pulsed signal of frequency $5f_o$ on its output 71.

The first subline pulse increments counter 28 to 1 thus providing the character generator with an indication that the first subline is to be read out of the RAM 20.

The pulses from output 70 increment the print address counter $48_A$ via input $47_A$ for sequentially scanning the content of the RAM 20. The content of the RAM at each address location is thus sequentially read out of the RAM at output 23 and presented to the character generator 24 for generating a corresponding signal configuration for the subline designated by counter 28.

Each such configuration is output as a five bit series signal under control of the count-of-five counter 29 to one input of AND gate 32. As long as this gate is enabled, the five bit signal is serially entered in the shift register 34 under control of output 71. Each address location of the RAM from one to 80 is similarly interrogated by counter $48_A$ and corresponding five bit signals are sequentially stored in the 400 bits store 34 for any period during which AND gate 32 is passing, i.e., when bisstable 62 is set. Owing to comparators 52 and 54, this bistable 62 is set as soon as the address count in counter $48_A$ has passed the count stored in store 60 and is reset when the count address of counter $48_A$ reaches the number stored in address counter 48. Thus, during the printing process, all address locations 1 to 80 of the RAM are always examined but only those characters whose addresses are comprised between the contents of store 60 and counter 48 are printed. This process takes place during the pulse train of 400 $f_o$ pulses which controls the loading of register 34 as depicted by FIG. 2.

When all address locations of RAM 20 have been looked at, as indicated to input 65 of the print control logic 64 by an overflow pulse appearing at output $49_A$ of counter $48_A$, the logic 64 sends from its output 74 a heating pulse (FIG. 2) to input 39 of the printing head 38 which heats up all those printing elements enabled by corresponding cells in the shift register 34. As represented on the timing diagram of FIG. 2, the printing heat pulse is followed by a motor drive pulse on output 76 which is applied to the DR input of circuit 45 via OR gate 137, and advances the motor one step forward as indicated to the F input of circuit 45 by logic level on output 75 of circuit 64. Still referring to FIG. 2, the motor drive pulse is followed by a pulse on output 72 incrementing counter 28 to designate the second subline to character generator 24 and the printing of the second subline then proceeds as explained for the first.

Figure 2:
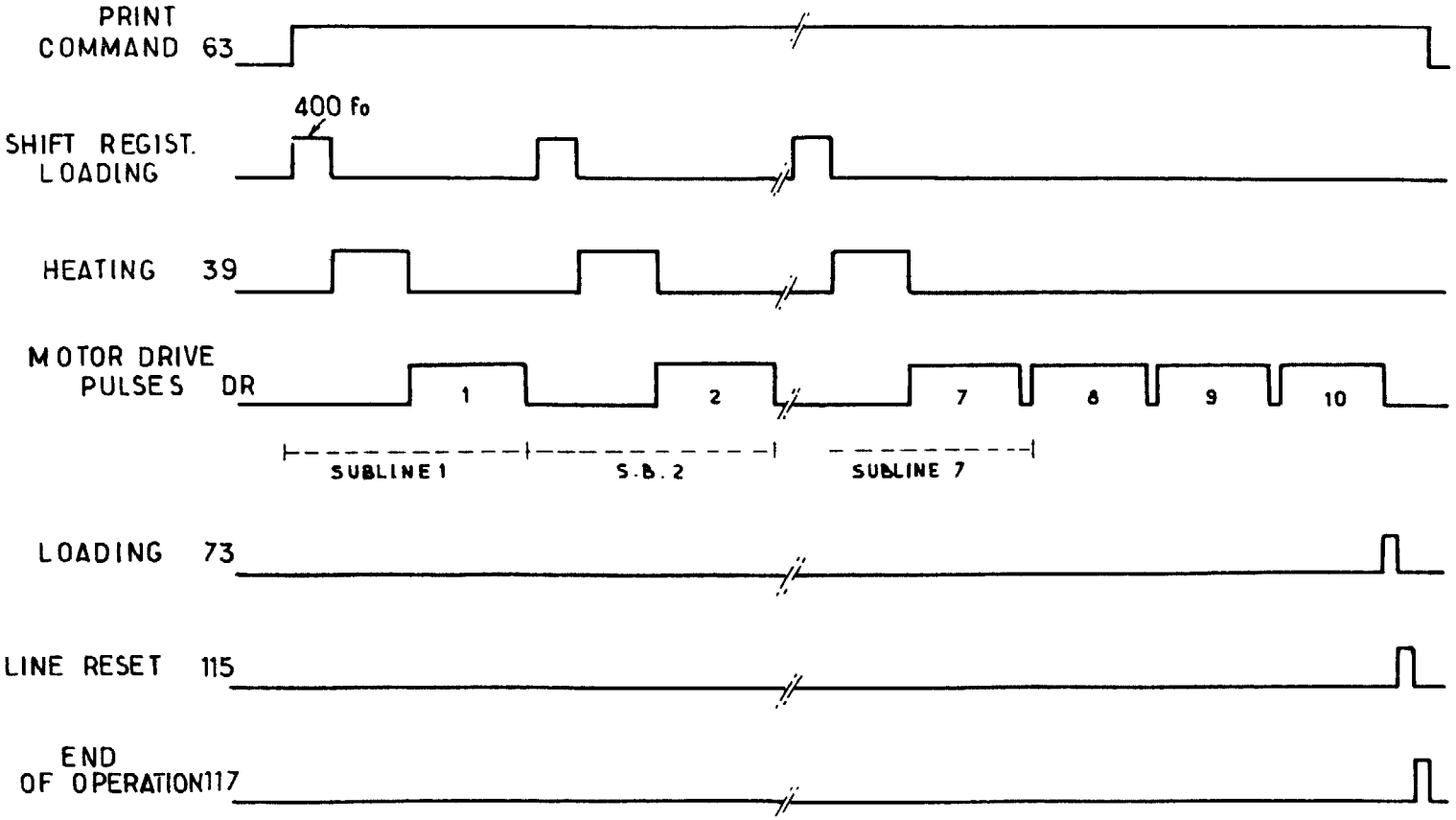
FIG. 2 is a wave form diagram illustrating some aspects of the operation of the printer of FIG. 1.

As shown by FIG. 2, the print control logic 64 controls a sequence of seven subline printings, during which address counter $48_A$ cycles from 1 to 80, which is followed by four motor driving pulses on output 76, the direction of rotation of the motor 44 remaining the same, i.e., forward. This advances the paper by a distance corresponding to the spacing between two consecutive lines of prints to a position ready for printing a new line. In this position, the line or part of line just printed is uncovered by the thermal head and can be readily seen by a keyboard operator or any observer. The paper will remain in that position until a new character representative signals entering process takes place and a new print command is produced at the output of OR 87. At this point a new printing operation will take place directly if no signal is produced at the output of OR gate 97 and, only after the paper has been moved back to present the line just printed in front of the printing head, if output of OR gate 97 is energized, as will be explained hereinafter.

The trailing edge of the fourth motor driving pulse then marks the beginning of a sequence of three successive pulses out of logic 64 (see diagram of FIG. 2) as follows:

(a) a loading pulse at output 73 of circuit 64 which enables store 60 to receive the content of address counter 48, i.e., the address of the last printed character, thus preventing, by AND gate 32, overprinting on printed characters when a portion of a line has already been printed and the printing of a subsequent portion of the same line of characters is undertaken during the next printing operation;

(b) a signal 115 which is operative via output 98 of AND gate 99 to reset store 60 and address counter 48 when and only when the printing operation just performed was the result of either a CR or an overflow at output 49 as detected by bistables 91 or 90 respectively.

The set output of bistable 90 or of bistable 91 in either case enables AND gate 99 via OR gate 96, thus permitting pulse signal 115 to produce a line reset pulse to reset 60 and 48. Note here that both store 60 and address counter 48 must be indeed restored to zero (thus indicating the beginning of a line) when a CR is received and the same applies if the line just printed contained 80 characters.

Signal 115 is also operative via AND gates 150 and 152 to set bistables 156 and 158, respectively at the end of a printing operation if respective bistables 84 (♭) and 91 (CR) were set by the print command which initiated the printing; and via AND gates 151 and 153 to reset the same bistables 156 and 158 if the respective Δ and CR bistables 84 and 91 were in their reset state during the printing operation, i.e., when a print command is present at the output of OR 87.

(c) a signal 117 to reset counters 28, 29, bistables 84, 86, 90 and 91, but not 156 and 158. This restores the output of OR gate 87 to zero and reestablishes the AKN availability signal at the output 16 for a new character entering phase.

In the case that only a portion of a line, instead of a complete line, had already been printed in response to a ♭ signal at the output of bistable 84, this fact has been detected by bistable 156 which has been set at the end of the printing operation which was triggered by the signal, and the portion of line just printed is left uncovered by the printing head. Thus, the motor 44 must be moved back ten steps in response to the output of OR gate 97 as soon as a new print command is received by OR gate 87 and before the respective printing operation starts.

Also, in the case that a line or portion thereof has been printed in response to a CR command the content of the store 60 is brought back to zero and the line or portion thereof is left uncovered and must be moved back under the printing head before the next printing operation takes place, in accordance with the definition of CR command. This fact is detected by bistable 158 which is set by the pulse 115 at the end of a printing operation triggered by the CR command and remains set after the end of the respective printing operation and until another printing operation controlled by a Δ, a LF or a 80K command terminates and the corresponding signal 115 is emitted by logic circuit 64 (thus causing AND gate 153 to reset bistable 158). The set state of 158 is detected by OR gate 97 which will cause the motor 44 to move back ten steps as soon as a new print command is received by OR gate 87 and before the respective printing operation starts.

Whenever one of these two situations produces a signal at the output of OR gate 97, the printing control input 63 is temporarily inhibited by the operation of the AND gate 142 which is disabled as long as a signal is present at the output 124 or gate 130. Gate 130 in turn is enabled by the outputs of OR gate 97, OR gate 87 and divide-by-ten circuit 140 so as to set the direction control input of motor drive circuit 45 to reverse (R). The output 124 of gate 130 is also operative to enable AND gate 126 for passing ten pulses from clock 80 to the drive input DR of circuit 45 via OR gate 137, thus causing the motor 44 to move 10 steps backwards. The divide-by-ten circuit 128 detects the tenth pulse at the output of gate 126 whereupon it cancels the validation of gate 130 by its output 140, thus causing motor 44 to stop and Reverse control signal 124 to return to level zero. This reenables gate 142 to pass the print command out of OR 87 to input 63. From this point on, the printing operation of the characters designated by the respective contents of store 60 and address counter 48 takes place exactly as has been explained hereinabove, divide-by-ten circuit 128 being reset by 117 at the end of the printing cycle.

If the line or portion thereof was previously printed in response to an address counter overflow (80K) signal 49 or a line feed LF signal, the bistables 156 and 158 are in a reset state and, upon occurrence of the next print command at the output of OR gate 87, whatever series of new characters might have been entered is printed on the next line without any preliminary reverse movement of the paper, since no Reverse signal is produced at the output of OR gate 97.

Note that when a print command is received, even though no new character has been entered since the last printing operation, a new printing operation takes place which will result in printing only blanks and will advance the paper nevertheless.

Figure 3:
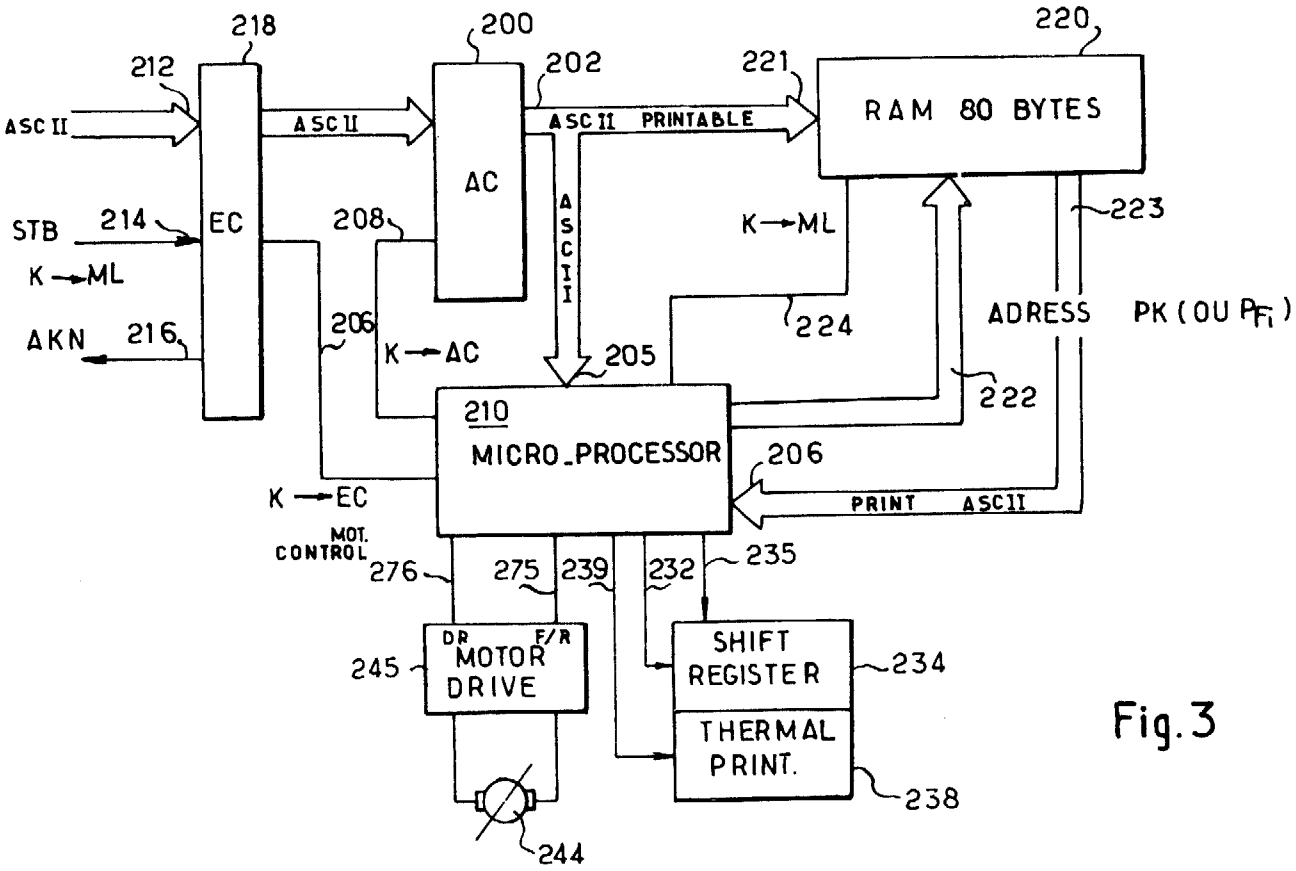
FIGS. 3, 4 and 5 are diagrams used in illustrating a second embodiment of the invention.
Figures 4, 5:
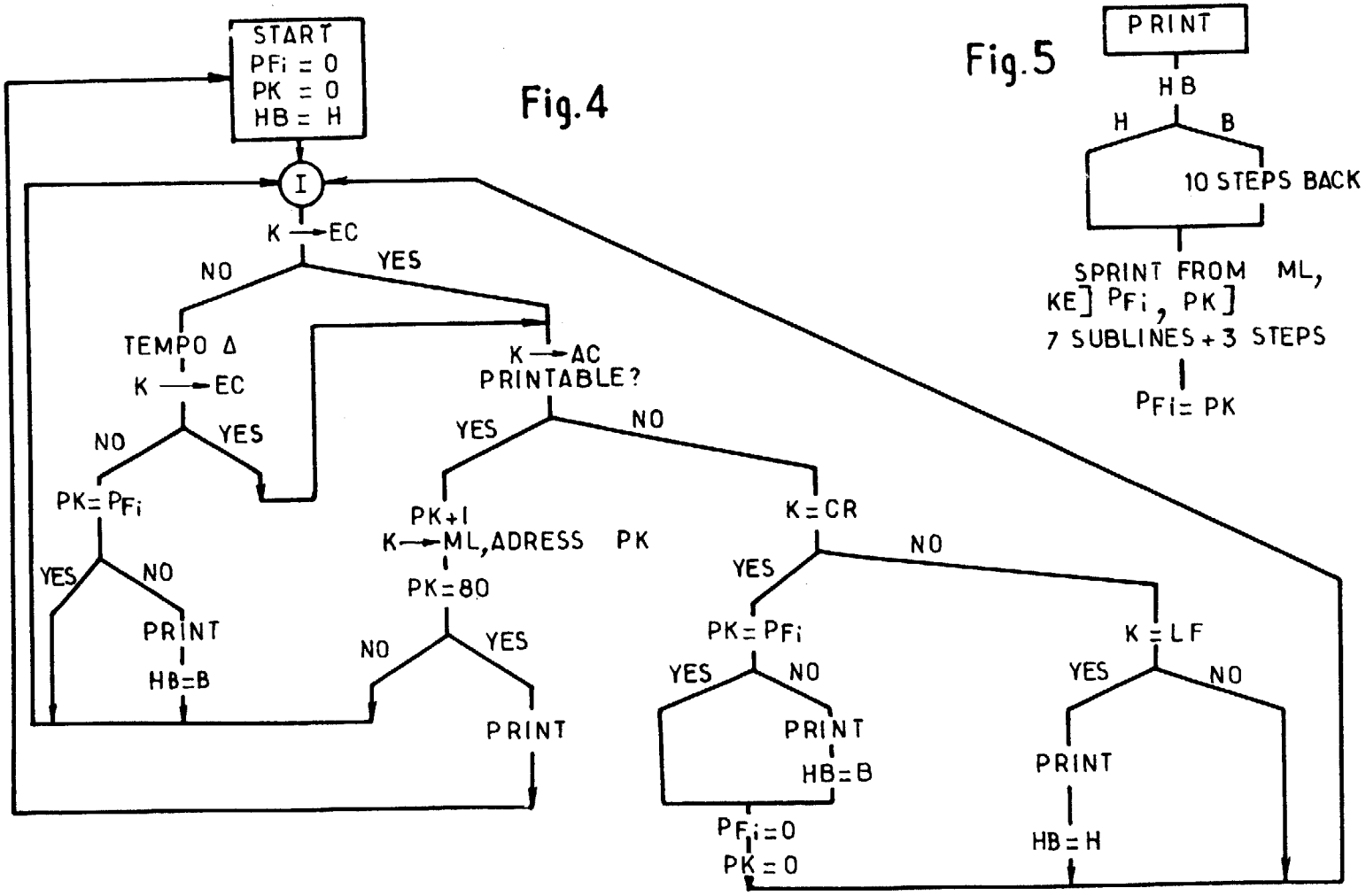

FIGS. 3, 4 and 5 illustrate an embodiment of the invention in a thermal line printer controlled by means of a micro-processor which permits to reduce the amount of discrete logic circuitry needed to control the printer. Referring to FIG. 3, the ASCII coded character representative signals are received on inputs 212 of an input register 218 while the strobe pulse STB is received by input 214 thereof.

The ASCII coded signals are passed to a character analysis register 200 which holds the character representative signal while it is being analyzed by microprocessor 210, in a manner similar to that performed by circuit 100 of FIG. 1, to pass printable character representative signals from its output 202 to input 221 of a Random Access Memory 220. The ASCII character representative signals are also presented by output 202 of register 200 to input 205 of the micro-processor 210 which comprises an input/output circuit chip, a processor chip and a read only memory ROM chip programmed as illustrated by FIGS. 4 and 5. These elements are well known and not shown.

Microprocessor 210 interrogates register 218 for strobe signals STB via line 206 and enables analysis register 200 via line 208 in response to each STB signal. Output 216 is used to pass an acknowledge signal AKN to the data processor and/or keyboard issuing the ASCII coded signals when input register 218 is empty.

The micro-processor 210 controls a driving circuit 245 of a stepping motor 244, by two control lines 275 and 276 respectively connected to a forward-reverse F/R input and to a pulse drive input DR of circuit 245. It is also coupled to a 400-bit shift register 234 arranged to control a 400-element thermal printing head 238, with output 232, coupled to load dot printing control bits into register 234, output 235 coupled to shift control input of 234 and output 239 controlling the heating of thermal head 238. Line 224 is used by the microprocessor to enable the RAM when a printable character has been detected in register 200. The microprocessor 210 also communicates via address lines 222 with RAM 220 for controlling the storage at proper locations of the ASCII printable character signals available at input 221 and the transfer of such signals from respective RAM locations into microprocessor 210 via ASCII code lines 223 for generation of corresponding printable serial bit configurations to be loaded into register 234. Microprocessor controlled thermal printers are known in the art and the details of such character generation thereby need not be discussed here for the understanding of the invention.

A printing operation is initiated by the microprocessor 210 each time one of the following signals is detected on its input 205: LF—Line Feed and CR—Carriage Return, both defined as previously done with respect to the embodiment of FIG. 1.

Other commands for the printing operation are 80K when 80 characters representative signals have been loaded in RAM 220 and Δ when a delay greater than a predetermined time interval is detected between the presentation of two successive characters to input register 218.

Each time one of the four preceding print commands appears, it triggers the subroutine of FIG. 5 which starts by a check of a flag HB which is set at level H whenever the printing head is at the top of a line, or part of a line, which must be printed in response to the command and at level B whenever the printing head is at the bottom of such line or part of line. In accordance with the subroutine of FIG. 5, if the flag is found to be at level H, the printing operation is performed for all ASCII characters in the RAM at locations designated by ML and comprised between two markers $P_{Fi}$, and $P_k$, including that at address $P_k$, but not that at address $P_{Fi}$. $P_{Fi}$ is set at the address of the last character of the line printed during a previous printing sequence and $P_k$ was set at the address of the last character entered in the RAM 220 when the print command was received.

The printing operation comprises the generation of appropriate character configurations for seven sublines with a respective advance of the paper driving motor by one step between each subline and the subsequent advance of the motor by four more steps after the end of the seventh subline, all under control of the microprocessor.

At the end of the printing operation the marker $P_{Fi}$ is set at the same address as $P_k$ ($P_{Fi}=P_k$).

Thus, in any printing operation, the portion of a line printed contains characters comprised between the last character previously printed and the last character entered in the RAM, inclusive of the latter.

Remaining with FIG. 5, if the flag is found to be set at level B, microprocessor moves the motor 244 ten steps backwards, then proceeds with the printing operation in a manner identical with what was described in relation to the case when the flag was at H.

Turning now to FIG. 4, at the beginning of operation of the printer (START on FIG. 4) the marker $P_{Fi}$ is set to zero, marker $P_k$ to zero, and the flag HB is set at level H.

The following symbols have their meaning explained below with reference to operation of the microprocessor:

K: character being handled;

K→EC: any character entered in input register 218?

K→AC, PRINTABLE?: transfer character in character analysis register 200 and check if printable or not?

K→ML, ADDRESS $P_k$: send K to address location $P_k$ in RMA via memorization lines 222.

K−RC, or LF: If K is not printable, is it equal to RC or LF, or has it no meaning for the printing operation?

Tempo Δ: Wait during Δ time interval.

With these in mind, the understanding of the connections between operating instructions stored in the read only memory of microprocessor is straight forward as evidenced by the few examples below of how to read FIG. 4: After the start of the operation (START) the microprocessor interrogates register 218 via 206 (point I) to check if a strobe pulse STB indicating the presence of a character has been received (K→EC). If YES, it transfers it to the character analysis register and checks if printable or not (K→AC, PRINTABLE?). If YES, it increments $P_k$ by one, sends the character to memory location at new address $P_k$ (K→ML, ADDRESS $P_k$) and checks if new $P_k=80$. If NO, it returns to point I to enter new character. If YES, it prints all characters entered since last printing (PRINT) and goes back to START to set $P_{Fi}$ to 0, $P_k$ to 0 and HB to H to start a new line.

If answer to K→AC, PRINTABLE? is NO, the microprocessor checks if the non-printable character is K=CR, and, in the negative, if it is K=LF and if not (NO) goes back to point I.

If K=CR (YES) the microprocessor checks if the address of the last printable character entered ($P_k$) is that of the last printed ($P_{Fi}$), if YES, set both $P_{Fi}$ and $P_k$ to zero in accordance with the definition of the CR command and returns to I, and, if NO, prints, sets the flag HB to B so that the next printing operation will occur on the same line (see 10 steps motor reverse in FIG. 5 subroutine) in accordance with the definition of CR before setting back $P_{Fi}$ to zero and $P_k$ to zero and returning to I.

If K=LF, a printing operation (PRINT) takes place (even if $P_{Fi=Pk}$ in which case only blanks are printed) and the flag HB is set to H before returning to I, so that the next printing operation will occur on the next line (no motor reversal).

Note that, if a CR is immediately followed by a LF, or vice versa, in the input register 218, their combined effect will be $P_{Fi}=0$, $P_k=0$ and HB=H which are the conditions to start a new paragraph after a line of less than 80 characters has been printed.

Returning to point I, if no character is present in register 218 upon interrogation by the microprocessor, a new interrogation (K→EC) is made after a delay (Tempo Δ). If a character is present (YES) it is transferred to AC register 200 and analyzed (K→AC, PRINTABLE?).

If no character is present after the delay (NO) (as when a relatively slow typist operates a keyboard for example, or a fast typist stops in the middle of a line), a check is made to see whether the last character printed is last entered and:

If YES, the microprocessor returns to I;

If NO, the portion of line not previously printed is printed (PRINT) and the flag is set to HB=B, so that the next printing will again occur on the same line, and the microprocessor returns to I.

It is thus seen that with this implementation, as soon as characters are not continuously fed to the printer at relatively high speed, (as determined by the setting of Δ) the section of line not printed will be printed and be left uncovered by the printing head for observation until characters feeding resumes.

The embodiment just described can be implemented with a microprocessor of the popular type F8, originally developed by Fairchild Co. and now available with all the large semiconductor chip manufacturers and an ROM memory having a capacity of 1 Kilo byte is sufficient for implementing the corresponding instructions to produce the circuit operating as described for controlling the printer.

Thus, a printer has been developed in accordance with the two embodiments just described which provides a combination of advantages of parallel line printers and character by character printers.

Parallel printers authorize fast printing since an entire line is printed wholly or substantially simultaneously. However, with this principle of operation of conventional parallel printers, an operator or user may not visualize the characters which are entered in the printer until a full line capacity has been supplied to the printer or until a LF comannd is received. This disadvantage is not found in character by character (or serial) printers, wherein any character received is printed and is, or soon becomes, visible to the operator, i.e., is uncovered by the printing head.

The principle of operation of a parallel printer described above authorizes both visualization of the last character or characters entered when they are transmitted at low frequency, and fast printing resulting from parallel operation when the characters are transmitted at high frequency. The frequency threshold which triggers the switch from one mode of operation to the other may be adjusted at will by action of the delay Δ.

Such mode of operation has been made possible by providing a parallel printer which is arranged to print less than a full line under certain conditions and is capable of resuming printing along the same line afterwards in contrast with conventional parallel printers. Moreover, in a printer wherein a portion of a line just printed may be covered by the printing head, the print support is caused to move with respect to the printing head, to uncover the portion of line just printed, and to move back to its previous position before printing along the same line is resumed. In a thermal printer such as described where forward movement of the paper essentially takes place during the printing of the portion of line considered, the latter is uncovered by the thermal head at the end of the printing operation. It follows that, before the printing of the same line can be resumed, the paper must be restored to its initial preprint position relative to the thermal printing head.

According to an additional aspect of this technique, it should be noted that whether the paper should or not be moved backwards, after a printing operation has been performed along a line and the paper has advanced, but before a new one takes places, depends upon the nature of the command that initiated the former printing operation. If the command was a CR or a Δ, the paper must be moved back before the next printing starts. The corresponding indication is memorized by the setting of a memory circuit or of a flag. In addition, the nature of each print command also determines by means of proper memorization the position along a given line wherein a new printing operation will start. Typically, if the print command is a Δ or a LF, the next printing of characters will start from the position next to that of the last character printed in response to the Δ or LF command. In the case of a Δ, this will preclude overprinting of characters already printed in response to the Δ. If the command was CR or 80K, the next printing of characters will typically start at the beginning of a line. In the case of a CR alone (not combined with a LF) this will allow printing of new characters over characters of a line already printed. This duplicates the operation of a conventional serial printer in response to a CR signal.

I claim:

1. Parallel line printing apparatus for printing successive lines of characters across a print support material comprising:

parallel printing head means arranged to extend in the direction of a line across the print support material;

electrical signal storage means for receiving and storing electrical signals representative of characters to be printed, and storage means having a capacity sufficient to store electrical signals corresponding to a plurality of characters; and print control means for receiving print command signals and controlling the performance of a printing operation in response to each such print command signal received by causing said printing head means to substantially simultaneously print characters corresponding to electrical signals stored in said storage means along a line on the print support material opposite said printing head means;

said print control means being selectively responsive to at least one of the print command signals received for causing said printing head means to resume the printing of characters along a line containing at least one character already printed during a previous such printing operation.

2. Parallel line printing apparatus according to claim 1 wherein the capacity of said storage means corresponds to at least one full line of characters.

3. Parallel line printing apparatus according to claim 1, wherein said print control means is responsive to both the print command signal which controlled the performance of said previous printing operation and to a subsequent print command signal to resume said printing along said line.

4. Parallel line printing apparatus according to claim 1, wherein said print control means comprises means for preventing overprinting of characters already printed along a line during said previous printing operation upon resumption of the printing of characters along such line.

5. Parallel line printing apparatus according claim 1, wherein said print control means comprises means responsive to each such print command signals received for producing relative forward displacement between said printing head means and the print support material from a position wherein said printing head means is opposite a line containing at least one character printed in response to such print command signal on the print support material to a position wherein it is displaced with respect to such line and said print control means further comprises reversing means selectively responsive to said at least one print command signal received to produce reverse relative displacement between said printing head means and the print support material from the position wherein said printing head means is displaced relative to the line containing said at least one printed character to the position wherein it is back opposite thereto, before the resumption of printing.

6. Parallel line printing apparatus according to claim 5, wherein said reversing means is responsive both to the print command signal which controlled the performance of said previous printing operation along the line and to a further such print command signal to resume the printing of characters along said line.

7. Parallel printing apparatus according to claim 1 further comprising means responsive to the interval between the respective times when the signals representative of successive characters are received by said storage means for producing said at least one print command signal.

8. Parallel line printing apparatus for printing successive lines of characters across a print support material, comprising:

parallel printing head means arranged to extend in the direction of a line across the print support material;

electrical signal storage means for receiving and storing electrical signals representative of characters to be printed, said storage means having a capacity sufficient to store electrical signals corresponding to a plurality of characters;

print control means for receiving print command signals and controlling the performance of a printing operation in response to each such print command signal received by causing said printing head means to print characters corresponding to electrical signals stored in said storage means along the line of print support material opposite said printing head means; and moving means for producing relative displacement between the printing head means and the print support material transversely of the direction of said printing head means;

said print control means being also operative for controlling said moving means to produce such relative displacement in a forward direction after each such print command signal has been received so that the printing head means is displaced with respect to the line containing any character just printed in response to such print command signal at the end of a printing operation; and said print control means being selectively responsive to at least one such print command signal to produce such a relative displacement in a reverse direction to a position wherein a line containing at least one character already printed is back opposite said printing head means.

9. Parallel line printing apparatus, according to claim 8, wherein said print control means is responsive to each such print command signal received to cause said printing head means to substantially simultaneously print the characters corresponding to electrical signals received in said storage means since the last printing operation was performed and up to the time of reception of the respective print command signal.

10. Parallel printing apparatus in accordance with claim 8, wherein at least one print command signal is the signal which caused the printing of said at least one character already printed on the line which is back opposite said printing head means before a following printing operation is performed in response to a subsequent print command signal.

11. Parallel printing apparatus in accordance with claim 10, wherein said print control means is also responsive to the subsequent print command signal to produce such relative reverse displacement.

12. Parallel printing apparatus according to claim 8, wherein said print control means includes means responsive to said at least one print command signal to produce such reverse relative displacement before the beginning of a printing operation caused by said at least one print command signal.

13. Parallel printing apparatus according to claim 8, wherein said print control means includes first means responsive to each such print command signal to produce such relative displacement in a forward direction and second means responsive to said at least one print command signal to produce said displacement in a reverse direction after the respective displacement in a forward direction and just before the next printing operation following said displacement in a forward direction.

14. Parallel printing apparatus according to claim 13, wherein said second means is also responsive to the print command signal causing said next printing operation to produce said relative reverse displacement.

15. Parallel printing apparatus according to claim 8, further including means for receiving an external command for applying said at least one print command signal to said print control means in response to said external command.

16. Parallel printing apparatus according to claim 15, wherein said external command is a carriage return command.

17. Parallel printing apparatus according to claim 8, further including means responsive to a condition of the character representative signals received by said storage means for applying said at least one print control signal to said print control means.

18. Parallel printing apparatus according to claim 17, wherein said condition is a function of the time interval between the signals representative of successive characters received by said signal storage means.

19. Parallel printing apparatus according to claim 8, further including means responsive to a line feed command for producing one of said print command signals.

20. Parallel printing apparatus according to claim 8, further including means for detecting that a number of printable character representative signal corresponding to the full capacity of a line has been received by said storage means to produce one of said print command signals.

21. Parallel printing apparatus according to claim 13, wherein said second means includes means presettable in response to said at least one print command signal to control said reverse displacement in response to the subsequent print command signal applied to said first means.

22. Parallel printing apparatus according to claim 8, further comprising means for memorizing the position in a line of print of the last character printed during a given printing operation on such line.

23. Parallel printing apparatus according to claim 22, wherein said print control means is operative to scan the entire content of said storage means in response to each said print command signal and further includes means responsive to said memorizing means to inhibit the printing of characters for all positions in the line corresponding to characters already printed.

24. Parallel printing apparatus according to claim 23 including further means for memorizing the position in a line of print of the character corresponding to the last representative signal received by said storage means, said print control means being responsive to said further memorizing means for causing the printing of only those characters between positions memorized by both these memorizing means.

25. Parallel printing apparatus according to claim 22 further including means for resetting said memorizing means to a reference position in the line in response to some of the print command signals, at the end of the respective printing operation.

26. Parallel printing apparatus according to claim 8, wherein said print control means is also effective to produce said forward relative displacement in response to at least some of the print command signals when no character representative signals have been received and stored by said storage means since the last printing operation was performed.

27. Parallel printing apparatus according to claim 8, wherein said print control means is responsive to said print command signal to produce said forward relative displacement during the course of the respective printing operation.

28. Parallel printing apparatus according to claim 27, wherein said print control means is operative to control the performance of a printing operation by sequentially printing N sublines containing element marks corresponding to the character being printed, said print control means being responsive to the printing of each such subline to produce a respective forward relative displacement between the printing head means and the print support material.

29. Parallel line printing apparatus according to claim 8, wherein said storage means is also responsive to said print command signal to interrupt the reception of such character representative signals during the printing operation performed under control of said print control means in response to said print command signal.

30. Parallel line printing apparatus for printing successive lines of characters across a print support material, comprising:

parallel printing head means arranged to extend in the direction of a line across the print support material;

signal storage means for receiving and storing signals representative of characters to be printed, said storage means having a capacity sufficient to store signals corresponding to a plurality of characters;

timing means for producing a print command signal when the duration of a time interval between successive ones of said received signals exceeds a predetermined value; and print control means responsive to said print command signal for causing said printing head means to print characters corresponding to signals stored in said storage means when said print command signal is produced on the print support material along the line opposite said printing head means.

31. Parallel printing apparatus for printing successive lines of characters across a print support material comprising:

parallel printing head means arranged to extend in the direction of a line across the print support material for allowing the parallel printing of a plurality of marks belonging to different characters along the line opposite said printing head means on said print support material;

storage means for receiving and storing signals representative of a plurality of characters to be printed; and print control means responsive to the interval between the respective times when the signals representative of successive characters are received by said storage means for controlling the performance of a printing operation when such time interval satisfies a predetermined relationship by causing said printing head means to effect the parallel printing of character marks corresponding to a plurality of the signals stored in said storage means when such predetermined relationship is satisfied along the line opposite said printing head means on the print support material.

32. Parallel printing apparatus according to claim 31 wherein said print control means is operative to cause the printing of characters by said printing head means to resume on the same line after the performance of said printing operation.

* * * * *